US009737099B1

(12) United States Patent
Khoury

(10) Patent No.: US 9,737,099 B1
(45) Date of Patent: Aug. 22, 2017

(54) REVERSIBLE FOUR WAY TIE

(71) Applicant: Felix D. Khoury, Miami, FL (US)

(72) Inventor: Felix D. Khoury, Miami, FL (US)

( * ) Notice: Subject to any disclaimer, the term of this patent is extended or adjusted under 35 U.S.C. 154(b) by 0 days.

(21) Appl. No.: 15/464,911

(22) Filed: Mar. 21, 2017

(51) Int. Cl.

| | |
|---|---|
| ***A41D 25/02*** | (2006.01) |
| ***A41D 15/00*** | (2006.01) |
| ***A41D 27/08*** | (2006.01) |
| ***A41D 25/00*** | (2006.01) |
| ***A41D 25/04*** | (2006.01) |

(52) U.S. Cl.
CPC ..... *A41D 15/005* (2013.01); *A41D 25/003* (2013.01); *A41D 25/005* (2013.01); *A41D 25/025* (2013.01); *A41D 25/04* (2013.01); *A41D 27/08* (2013.01)

(58) Field of Classification Search
CPC ..... A41D 25/02; A41D 25/022; A41D 25/025
See application file for complete search history.

(56) References Cited

U.S. PATENT DOCUMENTS

| | | | | |
|---|---|---|---|---|
| 2,470,973 | A * | 5/1949 | Bovee | A41D 25/025 2/137 |
| 3,955,217 | A | 5/1976 | Levy | |
| 3,959,825 | A | 6/1976 | Hughes | |
| 4,173,792 | A | 11/1979 | Intengan | |
| 4,318,189 | A | 3/1982 | Intengan | |
| 4,504,979 | A | 3/1985 | Kawamura | |
| 4,573,219 | A | 3/1986 | Hooten | |
| 4,575,872 | A | 3/1986 | Chen | |
| 4,835,821 | A | 6/1989 | Durante | |
| 5,095,546 | A | 3/1992 | Jones | |
| 5,216,757 | A | 6/1993 | Dorkin | |
| D341,929 | S | 12/1993 | Gaffney | |
| 5,337,457 | A | 8/1994 | Chennault | |
| 5,353,438 | A | 10/1994 | Voiles | |
| 5,400,439 | A | 3/1995 | Petroff | |
| 5,432,953 | A | 7/1995 | Kim | |
| 5,493,731 | A * | 2/1996 | Amnott | A41D 25/022 2/148 |
| 5,774,893 | A | 7/1998 | Torres | |
| 5,815,836 | A | 10/1998 | Jacobson, II | |
| 5,836,018 | A | 11/1998 | Lee | |
| 5,983,461 | A | 11/1999 | Chen | |

(Continued)

FOREIGN PATENT DOCUMENTS

| | | |
|---|---|---|
| EP | 381251 A2 | 8/1990 |
| EP | 255849 B1 | 9/1991 |
| WO | 9300835 A1 | 1/1993 |

*Primary Examiner* — Tejash Patel
(74) *Attorney, Agent, or Firm* — Albert Bordas, P.A.

(57) ABSTRACT

A reversible necktie having a knot assembly, a knot section, an apron section, and a strip assembly. The knot assembly has first and second faces, and a dividing wall; wherein the first face has a different appearance that the second face. The knot section has folding guides and bottom knot section edges. The knot section has upper knot section faces with a knot section slit and lower knot section faces. The strip assembly has a strip having first and second slit, a hook fastener and a loop fastener. The apron section has first and second aprons. The first apron has a first appearance that is different from a second appearance of the second apron. Either first or second face is positioned outwardly to coordinate with either first or second aprons to achieve four possible combinations to wear.

16 Claims, 5 Drawing Sheets

(56) References Cited

U.S. PATENT DOCUMENTS

| | | | | |
|---|---|---|---|---|
| 6,094,746 | A | 8/2000 | Miller | |
| 6,131,200 | A | 10/2000 | McNamara | |
| 6,363,533 | B1 * | 4/2002 | DeLuca | A41D 25/02 2/145 |
| 6,687,914 | B2 | 2/2004 | Conyers | |
| 6,691,319 | B1 | 2/2004 | Simon | |
| 6,857,167 | B2 | 2/2005 | Bishop | |
| 6,920,642 | B2 | 7/2005 | Dickens | |
| 7,065,794 | B2 | 6/2006 | Anderson | |
| 7,346,934 | B1 | 3/2008 | Scott | |
| 7,458,105 | B2 | 12/2008 | Tao | |
| 7,530,119 | B1 | 5/2009 | Jackson-Miller et al. | |
| 7,716,750 | B2 * | 5/2010 | Sato | A41D 25/003 2/152.1 |
| 8,713,713 | B2 | 5/2014 | Yan | |
| 8,931,116 | B2 | 1/2015 | Lucero | |
| D741,043 | S | 10/2015 | Stikeleather | |
| D767,247 | S | 9/2016 | Sbarigia et al. | |
| D772,528 | S | 11/2016 | Burden et al. | |
| 2002/0095713 | A1 | 7/2002 | Bonano et al. | |
| 2004/0187187 | A1 | 9/2004 | Morrison-Gale | |
| 2014/0283278 | A1 | 9/2014 | Jordan | |

* cited by examiner

REVERSIBLE FOUR WAY TIE

BACKGROUND OF THE INVENTION

1. Field of the Invention

The present invention relates to neckties, and more particularly, to reversible neckties.

2. Description of the Related Art

Applicant believes that one of the closest references corresponds to U.S. Pat. No. 3,955,217 issued to David H. Levy on May 11, 1976 for Permanently knotted necktie and method of making same. However, it differs from the present invention because Levy teaches a permanently knotted necktie that has an elongated necktie body having a front face and a rear face, a permanent necktie knot and inextensible strap for detachably fastening the necktie around a person's neck. The permanent necktie knot and the necktie body may be formed from a single strip of material or the knot and body may be formed from separate strips of material. In the former case, the knot is formed by one end of the strip material back onto the front face of the body and then folding the free ends of the folded-back portion around the body and fastening them together at the rear face. In the latter case, the knot is formed by folding one end of the body strip material back onto the rear face of the body and then encircling the knot strip material around the folded-back portion and fastening together the ends of the knot strip material at the rear face.

Applicant believes that another reference corresponds to U.S. Pat. No. 3,959,825 issued to John A. Hugues on Jun. 1, 1976 for Reversible necktie. However, it differs from the present invention because Hugues teaches a reversible four-in-hand necktie, which has a first side bearing a first pattern. A second side, bearing a different pattern, is connected to the first side. The first and second sides are symmetric; and together form a pair of relatively wide end portions, which are connected by a narrow neck portion positioned between the end portions. The reversible four-in-hand necktie is used and worn as any other four-inhand necktie, with the exception that either the first or second side is worn facing outward from the wearer.

Applicant believes that another reference corresponds to U.S. Pat. No. 4,173,792 issued to Franklin S. Intengan on Nov. 13, 1979 for Adjustable Length simulated knotted necktie combination. However, it differs from the present invention because Intengan teaches an adjustable length simulated knotted necktie combination composed of a necktie length having a front display tail portion and an opposite rear tail portion with an intermediate portion and an inverted trapezoidally shaped body of simulated knot shape as seen in front elevation and which body has an upper support surface to engage the intermediate portion of the necktie length between the tail portions to support the upper zone of the display tail portion adjacent the intermediate portion over the simulated knot shaped body and including a shield to wrap about the body and over the upper zone of the display tail portion and wherein neck engaging segments with quick release elements such as snaps are provided to serve as a neckband for attachment in the collar of the shirt of a wearer and which combination simulates a conventional knotted tie, is adjustable, washable, easy to assembly and is removable from the neck of the wearer by unsnapping the neck segments.

Applicant believes that another reference corresponds to U.S. Pat. No. 4,318,189 issued to Franklin S. Intengan on Mar. 9, 1982 for Simulated knotted necktie. However, it differs from the present invention because Intengan teaches a simulated knotted necktie composed of a hollow knot shaped body having a main front face, a rear face with a first hole centrally arranged and having a lower lip, a bottom face with a hole and a top surface with the side walls of the body each having an opening adjacent the top face and a necktie length with a display tail overlaying and jacketing the main body face, a rear tail and a neck loop length between the tails with the neck loop length extending from said body openings and the rear tail or hidden tail extending from the bottom hole and the display tail extending from the rear face hole with the rear face of the display tail overlaying the main face of the body and a keeper to hold the display tail in snug jacketing relation of the main face of the body to simulate a knot of a necktie of predetermined style.

Applicant believes that another reference corresponds to U.S. Pat. No. 4,504,979 issued to Hironobu Kawamura on Mar. 19, 1985 for Necktie assembly. However, it differs from the present invention because Kawamura teaches a necktie assembly fittable and removable to a wearer's neck without tying or untying a knot thereof, which has a tie body having a shape similar to a traditional tie and a knot formed by tying a part of the tie body around a core body. The core body has a channel by which a free end of the tie body can be inserted into the knot while keeping a neatly folded shape thereof. The necktie assembly may have a pin or the like built-in the core body for securing the necktie.

Applicant believes that another reference corresponds to U.S. Pat. No. 4,573,219 issued to Howard G. Hooten on Mar. 4, 1986 for Necktie knot simulator. However, it differs from the present invention because Hooten teaches a necktie knot simulator adapted to be slidably positioned along a necktie and to fixedly detachably engage a portion of the necktie to maintain the knot simulator in the desired position on the tie.

Applicant believes that another reference corresponds to U.S. Pat. No. 4,575,872 issued to Cheng C. Chen on Mar. 18, 1986 for Necktie. However, it differs from the present invention because Chen teaches a necktie incorporating an interim gap on top of the cravat section, to permit passage of the strap tongue whereby the suspension length can be adjusted at will; a pair of snatch laps each extending from either corner on the base of the cravat, serving to fix the setting of the necktie to the collar and to shape the cravat; a fastening belt attached to either corner on the top of the cravat, to enclose the nape of the user by button coupling; permitting convenient adjustment of the standing length of the strap tongue and of the size of the cravat anytime.

Applicant believes that another reference corresponds to U.S. Pat. No. 4,835,821 issued to Alan J. Durante on Jun. 6, 1989 for Necktie fastening device with hidden pocket. However, it differs from the present invention because Durante teaches a necktie fastening device having a loop pile strip with two button holes for fastening to a shirt front. The loop pile strip having an outer surface and an inner surface which has an open topped pocket attached thereto in order to place an article or the like to be hidden from sight. A hook pile strip is placed between the designer label and the necktie so that when the loop pile strip and the hook pile strip are in position to be mated surface to surface, the necktie is secured and the necktie fastening device is invisible.

Applicant believes that another reference corresponds to U.S. Pat. No. 5,095,546 issued to Jerry R. Jones on Mar. 17, 1992 for Necktie restraint. However, it differs from the present invention because Jones teaches an apparatus for restraining a necktie to a shirt front. The apparatus includes a longitudinal strip of material on the wide underside portion of the necktie, stitched in place, and surrounded by a horizontal transverse loop containing a buttonhole for attachment to a shirt front button.

Applicant believes that another reference corresponds to U.S. Pat. No. 5,216,757 issued to Joshua Dorking on Jun. 8, 1993 for Knot simulating neck tie clasp. However, it differs from the present invention because Dorking teaches a tie knot apparatus including a front shell member having a top edge, a bottom edge, and first and second side edges, a rear shell member having a top edge, a bottom edge, and first and second side edges, the shell members being configured at the top and bottom edges to form an upper shell member opening and a lower shell member opening, the openings being for passing a neck tie, a joining mechanism on the first and second side edges for joining the front and rear shell members together. The bottom edges are preferably contoured at the lower shell member opening to create aesthetically appealing folds in the tie below the apparatus. A wedge member is secured to one of the shell members for pressing against the tie and creating an aesthetically appealing fold in the tie adjacent to the apparatus. One of the joining mechanisms includes a hinge for the shell members. The front shell member has an exterior surface shaped to resemble the appearance of a tie knot. A pin member extends from one of the shell members toward the other shell member for piercing a neck tie placed between the shell members and for securing the apparatus to the tie.

Applicant believes that another reference corresponds to U.S. Pat. No. 5,337,457 issued to Kennith Chennault on Aug. 16, 1994 for Neckwear anchoring device. However, it differs from the present invention because Chennault teaches a neckwear anchoring device for retaining neckties and the like in their intended position along the front portion of the wearer's garment. The anchoring device is received by the tie loop and attaches to the button threads of selected buttons on the shirt or blouse of the wearer. The device engages the button threads by sliding behind the button without the need for inserting the button through a buttonhole. The device is installed and removed by the wearer.

Applicant believes that another reference corresponds to U.S. Pat. No. 5,353,438 issued to Reggie Voiles on Oct. 11, 1994 for Necktie restraint. However, it differs from the present invention because Voiles teaches a device and method for restraining the tail of a necktie to the front of a shirt. The device includes a longitudinal strip of flexible material with a sewn longitudinal button-hole on one end and a circular hole on the other.

Applicant believes that another reference corresponds to U.S. Pat. No. 5,400,439 issued to Jordan Petroff on Mar. 28, 1995 for Hi-fashion, knottless necktie. However, it differs from the present invention because Petroff teaches a knotless necktie having three components, to assemble and adjust, the necktie gives the appearance of being a fashionable knotted necktie but which does not use a knot and eliminates any knot tieing. This necktie has a display streamer, a knotshaper and a neckband. Each of these components can be made of the same or of different materials, design patterns or colors. These components are assembled into a complete, ready to wear necktie. From the components of three knotless neckties, each of a different material, design pattern and color, nine different and fashionable knotless neckties can be assembled. Once the knotless necktie is assembled and adjusted for the wearer's neck size, no further adjustment is needed. This necktie can then be taken-off or put-on while maintaining the appearance of a fashionably knotted conventional necktie.

Applicant believes that another reference corresponds to U.S. Pat. No. 5,432,953 issued to Yong J. Kim on Jul. 18, 1995 for Neck tie structure with a tie knot former. However, it differs from the present invention because Kim teaches a neck tie structure, a tie, a neck band, and a knot former. The knot former has a groove extending from side to side on the knot former. The neck band is threaded through the groove. The neck band has fastener means at opposite ends to connect the neck band on a neck of a person wearing the tie. The tie has an intermediate tie loop portion mounted over a front face of the knot former with ends of the tie being projected along opposite sides and rearwardly of the knot former and rearwardly and beneath the neck band. The ends of the tie are extended upwardly and forwardly over the neck band between the intermediate tie loop portion and the knot former and downwardly beneath the knot former in lapped relation, the thus tied tie generating a tied knot about the knot former having an appearance of a four-in-hand knot.

Applicant believes that another reference corresponds to U.S. Pat. No. 5,774,893 issued to Miguel Grajales Torres on Jul. 7, 1998 for Simulated necktie knot and necktie combination. However, it differs from the present invention because Grajales teaches a necktie assembly having a simulated necktie knot and a neckband that allows a fabric necktie tail portion to be added without making a conventional knot. The neckband may be elastic and may be opened, closed, and adjusted in a number of ways. The simulated knot is made in a fashion that leaves a hollow pocket useful for carrying and concealing small articles of many sorts, among these objects a small microphone, which may be connected to a transmitter. The body of the simulated knot also serves as a display area for indicia of many sorts, such as emblems, advertising, and the like.

Applicant believes that another reference corresponds to U.S. Pat. No. 5,815,836 issued to Julius H. Jacobson on Oct. 6, 1998 for Method and apparatus for restraining a necktie. However, it differs from the present invention because Jacobson teaches an apparatus for anchoring a tie to a wearer's shirt, which presents an appearance while keeping the tie. The apparatus has two parallel rails attached to the back of a tie, which provide support for a horizontal collar with a slot. The horizontal collar is configured to travel along the vertical rails. An elongated member is adapted for vertical movement inside the slot of the horizontal collar. The elongated member may have button holes suitable for connection to a wearer's shirt.

Applicant believes that another reference corresponds to U.S. Pat. No. 5,836,018 issued to Ming Lee on Nov. 17, 1998 for Detachable necktie with magnetic field generating means. However, it differs from the present invention because Lee teaches a necktie, which includes a neckband adapted for putting over the user's neck, a plurality of magnetic elements fixedly mounted on the neckband at an inner side and equally spaced from one another and adapted to produce magnetic field for acting with the magnetic field of the body of the user, a coupling box coupled to the neckband, an apron unit, and a connector adapted to connect the apron unit to the coupling box.

Applicant believes that another reference corresponds to U.S. Pat. No. 5,983,461 issued to Jiann-Jong Chen on Nov. 16, 1999 for Structure of supporter for tie knot of knotting-free necktie. However, it differs from the present invention because Chen teaches a structure of supporter for a tie knot of a knotting free necktie having an outer shell and a back wing connected to the outer shell. The outer shell being of a reverse triangular shape having two waist portions concave inward of the outer shell, and being of a bow shape. A protective beam, resistant shoulders and protective tabs are provided at the rear side of the outer shell. A back wing is fitted onto the rear side of the outer shell, and two side wing portions being somewhat resilient are lightly pressed against the two resistant shoulders. When mounting a loop cord, two ends of the loop cord are first threaded in the supporter from the bottom of the protective tab, passing through the resistant shoulders, and threaded out of the supporter from the bottom of the protective beams, and then a fabric strip, which is a half of a conventional necktie, is wound around the supporter and knotted in order to form a tie knot whereby a knotting-free necktie is obtained.

Applicant believes that another reference corresponds to U.S. Pat. No. 6,094,746 issued to Scott H. Miller on Aug. 1, 2000 for Necktie knot cover and retaining device. However, it differs from the present invention because Miller teaches a necktie knot cover and retaining device that functions as a decorative knot cover or as a knot simulator. The knot cover consists of a one piece continuous body having a pair of slots for receiving portions of the necktie. The knot cover is generally shaped similar to the knot to which it is covered. The device can be used with other knots and clothing, and is not limited to neckties.

Applicant believes that another reference corresponds to U.S. Pat. No. 6,131,200 issued to Brian L. McNamara on Oct. 17, 2000 for Simplified tie restraint. However, it differs from the present invention because McNamara teaches an invisible tie restraint that replaces the standard tie tack or tie bar for restraining a necktie onto a shirt or blouse front. The restraint is made of a single piece of flat treated cloth, paper or plastic. The restraint has an upper end, a lower end, and a body connecting the two ends, the body containing a multiplicity of notch pairs. The lower end contains a loop entry into which the upper end is inserted, drawing the body through until one of the notch pairs reaches a "stop" position while capturing the label of the necktie within the looped formed thereby. The restraint is attached to the shirt front by attaching a shirt button into a button hole formed in the upper end of the restraint. The restraint takes the form of a modified label, the label having a tab into which the button hole is formed.

Applicant believes that another reference corresponds to U.S. Pat. No. 6,687,914 issued to Tyrone Conyers on Feb. 10, 2004 for Tycon II reversible necktie. However, it differs from the present invention because Conyers teaches a necktie that is reversible by a zipper to enable the necktie to reverse. A clear thread defines a fold line, or a crease, that runs vertically down the open and unzipped necktie structure and dually outlines the shape of a standard necktie. The zipper runs down the back of the necktie structure and connects the two flaps that are folded back evenly, as a result of using the clear fold lines. When the structure is unzipped and folded back, it reveals the other color pattern. The zipper is then rejoined on the opposite side and zipped up to reverse the necktie structure.

Applicant believes that another reference corresponds to U.S. Pat. No. 6,691,319 issued to Raphael Simon on Feb. 17, 2004 for Simulated necktie knot. However, it differs from the present invention because Simon teaches a simulated necktie knot for use with a necktie to create a necktie knot without necessitating the hand-tying of a knot. The simulated necktie knot has a flexible funnel shaped cup, simulating a necktie knot, and a rigid funnel shaped core that fits within the cup. The core is used to fill the space within the cup not otherwise occupied by the necktie. A clip, positioned within the cup, holds the necktie in place within the cup. An adjustable collar strap may be used with the simulated necktie knot to attach the tie around the user's neck.

Applicant believes that another reference corresponds to U.S. Pat. No. 6,857,167 issued to Donald Gene Bishop on Feb. 22, 2005 for Necktie restraining device. However, it differs from the present invention because Bishop teaches a necktie restraining device having two flexibly connected covers. The first cover is placed on the shirt button located above the necktie label on a necktie panel. The second cover and flexible connector are dropped through the opening between the necktie label and the front necktie panel. The second button cover is then placed on the shirt button located below the necktie label.

Applicant believes that another reference corresponds to U.S. Pat. No. 6,920,642 issued to Bart Dickens on Jul. 26, 2005 for Necktie knot simulator. However, it differs from the present invention because Dickens teaches a necktie knot simulator closely resembling the shape of a necktie knot consisting of a one piece body with three properly dimensioned, fully enclosed circular apertures, one at the upper right, one at the upper left, and one at the base to provide both a means to thread a necktie through the necktie knot simulator and compressive resistance. The backside of the necktie knot simulator is predominantly open to allow wearer access to the necktie. The front surface of the necktie knot simulator can be modified to include inlays, logos, patterns or even precious and semi-precious gemstones.

Applicant believes that another reference corresponds to U.S. Pat. No. 7,065,794 issued to Richard Anderson on Jul. 27, 2006 for Secure necktie. However, it differs from the present invention because Anderson teaches a necktie that is removably attachable to a button-down shirt of the type having a row of buttons disposed down the front thereof so as to prevent the necktie from moving out of place, the necktie has a single elongated article of clothing having a wide end having front and rear surfaces and a narrow end having front and rear surfaces, wherein a row of buttonholes is provided on the rear surface of the wide end and a corresponding first attachment button is provided on the front surface of the narrow end to attach the wide end to the narrow end such that the first attachment means is not visible on the front surface of the wide end, and wherein second row of buttonholes is provided on the rear surface of the narrow end to attach the rear surface of the narrow end to the row of buttons.

Applicant believes that another reference corresponds to U.S. Pat. No. 7,346,934 issued to Christopher P. Scott on Mar. 25, 2008 for Device and method for securing a necktie. However, it differs from the present invention because Scott teaches a device for securing a necktie to the front of a wearer's garment having a bar, sized to pass through a button hole and be retained behind it; a ring sized to allow the bar to pass therethrough; and a flexible connecting means joining the ring and the bar, the connecting means having a length sufficient to secure the necktie to the garment front, yet allow the secured necktie to move a distance away from the garment front; and the connecting means being of thickness sufficient to allow its passage though the button hole without interfering with the function of the button closure. The device is used in a method of securing the necktie to the garment's front, which has passing the ring between the necktie label and the posterior face, and moving the bar through the ring to encircle the label, and inserting the bar through the buttonhole.

Applicant believes that another reference corresponds to U.S. Pat. No. 7,458,105 issued to Richard Tao on Dec. 2, 2008 for Convertible and swiveling necktie. However, it differs from the present invention because Tao teaches a convertible and a swiveling necktie and a method of using the convertible and swiveling necktie. The convertible and swiveling necktie includes a knot body, a tail body, wherein the tail body swivels relative to the knot body, and the tail body is urged to settle at increments at approximately 180 degrees to maintain a desired side of a fabric tail. The knot body form an elliptically shaped receiving portion, the tail body forming an elliptically-shaped member that is received by the elliptically-shaped receiving portion, and wherein the tail body is swivel connected to the knot body.

Applicant believes that another reference corresponds to U.S. Pat. No. 7,530,119 issued to Jackson-Miller et al. on May 12, 2009 for Reversible necktie. However, it differs from the present invention because Jackson-Miller et al. teaches a reversible necktie, which maintains the conventional appearance of traditional neckties, yet its versatile design allows it to be worn by either gender. The necktie has two display sides and an integrated reversing mechanism that enables a user to reverse the tie to selectively expose either side. The necktie further has an integrated securing mechanism to allow the user to adjustably secure the reversible necktie to the user's shirt at the desired location. The necktie has an interfacing structure that provides for a durable construction, while not making the tie bulky or overweight.

Applicant believes that another reference corresponds to U.S. Pat. No. 8,713,713 issued to Ping Yan on May 6, 2014 for Necktie assembly. However, it differs from the present invention because Yan teaches a necktie assembly having a necktie and a necktie-knot ring, wherein an additional hanging strip is sewn on the necktie, and the necktie-knot ring is used for forming a necktie knot. The necktie-knot ring has a necktie-knot ring cavity, a necktie inlet-outlet opening and a string-hanging buckling hook, wherein the necktie-knot ring cavity is surrounded by a front shell and a rear shell of the necktie-knot ring and is used for enclosing the necktie. The necktie inlet-outlet opening is positioned on the rear shell and the necktie can pass from its top to its bottom. The string hanging buckling hook extends from any position at one side of the necktie inlet/outlet opening to the other side thereof.

Applicant believes that another reference corresponds to U.S. Pat. No. 8,931,116 issued to Adam Lucero on Jan. 13, 2015 for Pre-knotted adjustable necktie. However, it differs from the present invention because Lucero teaches a pre-knotted adjustable necktie that includes a pre-knot and a tie body worn about a collar by a person, tie body having a first and second end as well as a front and back to accommodate a surface design and pre-knot having a cover accommodating a cover surface design wrapped about a pre-knot form having channels, a cavity and hooked ends to hold and accommodate the insertion of a tie body making an individual fashion statement over coming the limitations of the modern day necktie.

Applicant believes that another reference corresponds to U.S. Patent Application Publication No. 2002/0095713, published on Jul. 25, 2002 to Bonano, et al. for Necktie and necktie and knot system. However, it differs from the present invention because Bonano, et al. teaches a separate necktie and knot as a pair for engaging a necktie with a knot. The knot is engaged over the ends of the tie, slid into place at the neck and secured. The separate band and knot avoid make necktie with a knot.

Applicant believes that another reference corresponds to U.S. Patent Application Publication No. 2004/0187187, published on Sep. 30, 2004 to Kelly Marie Morrison-Gale for Reversible no-tie necktie. However, it differs from the present invention because Morrison-Gale teaches a reversible no-tie necktie with integrated, reversible, restraint and a reversible knot structure. The reversible knot structure fastens about the necktie's main body. The reversible necktie retains prima facie traditional necktie aesthetics on its own and also retains such an appearance when the knot structure is secured in place. An integrated restraint is provided for means of confining the necktie's rear section ends from frontal view and may also be used for means of securing the necktie to a shirt.

Applicant believes that another reference corresponds to U.S. Patent Application Publication No. 2014/0283278, published on Sep. 25, 2014 to Benedict Jordan for Hook button simulated knot adjustable length necktie. However, it differs from the present invention because Jordan teaches a hook button simulated knot adjustable length necktie designed with a top and bottom portion. The top portion has an upside down half-frustum rubber device, with a continuous extension at the top on either side. The top portion also has a horizontal adjusting bar. The top portion is covered in fabric to make a simulated tie knot, which when worn has the appearance of a conventional tie knot finish. The hook button is installed at the back of the top portion, which is used for the necktie to be worn on the collar button. The bottom portion, the tail length, connects to the top portion to complete the finished necktie. The finished necktie requires no assembling by the wearer, it fits over the collar button and comfortably remains in place and the bottom portion, the tail length, is adjustable.

Applicant believes that another reference corresponds to U.S. Pat. No. D341,929 issued to James Gaffney on Dec. 7, 1993 for Reversible necktie. However, it differs from the present invention because Gaffney teaches an ornamental design for a different reversible necktie.

Applicant believes that another reference corresponds to U.S. Pat. No. D741,043 issued to Ian Stikeleather on Oct. 20, 2015 for Necktie with removable and replaceable tails. However, it differs from the present invention because Stikeleather teaches an ornamental design for a different necktie with removable and replaceable tails.

Applicant believes that another reference corresponds to U.S. Pat. No. D767,247 issued to Sbarigia, et al. on Sep. 27, 2016 for Tie. However, it differs from the present invention because Sbarigia, et al. teaches a design for a different tie having a specific shape at its upper end so it matches a knot shape when bent.

Applicant believes that another reference corresponds to U.S. Pat. No. D772,528 issued to Burden, et al. on Nov. 29, 2016 for Attachable necktie. However, it differs from the present invention because Burden, et al. teaches an ornamental design for a different attachable necktie.

Applicant believes that one of the closest references corresponds to WIPO Publication No. 93/00835, published on Jan. 21, 1993 to Vincent J. Plieggi for Improved apparatus for restraining a necktie and method for using the same. However, it differs from the present invention because Plieggi teaches an apparatus and method for restraining dangling sections of a necktie. The apparatus has a first section which attaches to the back of a necktie and a second section which slides along the first section and which attaches to a button on the front of the wearer's shirt.

Applicant believes that another reference corresponds to EP Patent No. 255,849 issued to Hironobu Kawamura on Sep. 18, 1991 for Built-in core body in ready-made knot of necktie. However, it differs from the present invention because Kawamura teaches a core body to be built-in to a readymade knot of a necktie, for maintaining a neat shape of the knot and for enabling a narrow band portion of the tie body to slide therethrough when putting on or taking off the necktie.

Applicant believes that another reference corresponds to EP Patent No. 381,251 issued to Hironobu Kawamura on Aug. 8, 1990 for Built-in core body. However, it differs from the present invention because Kawamura teaches a built-in core body for forming a readymade knot of a necktie, by which a neat knot is formed and permanently maintained, comprising an outer shell, a presser member, and a release member. A narrow band of a tie body is inserted in a channel formed in the interior of the outer shell in a double-folded state and the knot is formed around the core body in a conventional manner. The upward movement of the narrow band through the core body is inhibited by the action of the presser member while the downward movement thereof is free. Upward movement of the narrow band is allowed when the release member is operated to release the presser member from engagement with the narrow band.

Other patents describing the closest subject matter provide for a number of more or less complicated features that fail to solve the problem in an efficient and economical way. None of these patents suggest the novel features of the present invention.

SUMMARY OF THE INVENTION

The present invention is a reversible necktie comprising a knot assembly, a knot section, an apron section, and a strip assembly.

The knot assembly comprises first and second faces, and a dividing wall between them, wherein the first face comprises a first appearance that is different from a second appearance of the second face. The first and second appearances comprise at least one color, pattern, print, and/or design. The knot assembly comprises first and second top edges, and first and second bottom edges.

The knot section comprises first and second folding guides, and first and second bottom knot section edges. The first and second folding guides are each longer than the first and second bottom knot section edges respectively. The knot section comprises first and second upper knot section faces with a knot section slit, and first and second lower knot section faces. The strip assembly comprises a strip with first and second slits, a hook fastener and a loop fastener.

The apron section comprises first and second aprons. The first apron comprises a first appearance that is different from a second appearance of the second apron. The first and second appearances comprise at least one color, pattern, print, and/or design.

The knot section is positioned through the knot assembly, whereby the first and second bottom edges align approximately with either first or second bottom knot section edge. Either of first or second folding guides folds over the dividing wall and the first and second upper knot section faces are positioned between the dividing wall and the first or second face and are extend from first or second bottom edge. The strip assembly is positioned through the knot assembly and folds over the nearest first or second face until align the first slit with the knot section slit. Either first or second face is positioned outwardly to coordinate with either first or second aprons to achieve four possible combinations to wear.

It is therefore one of the main objects of the present invention to provide a reversible necktie.

It is another object of this invention to provide a reversible necktie that may be worn in any of four possible combinations.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED

Embodiment

Figure 1:
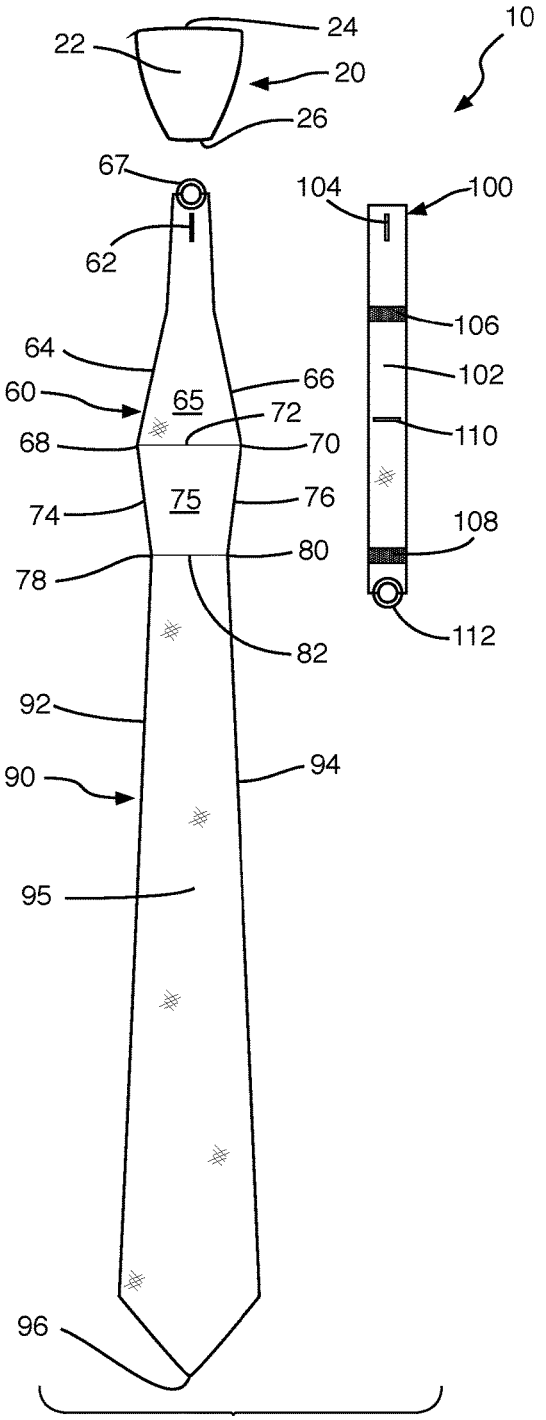
FIG. 1 is a front view of the present invention in a first of four possible combinations.

Referring now to the drawings, the present invention is a reversible necktie as is generally referred to with numeral 10. It can be observed that it basically includes knot assembly 20, knot section 60, apron section 90, and strip assembly 100.

As seen in FIG. 1, knot assembly 20 comprises face 22, top edge 24, and bottom edge 26. Face 22 comprises a predetermined appearance that may comprise at least one color, pattern, print, and/or design.

Knot section 60 comprises upper knot section face 65 and lower knot section face 75, which are defined by pull ring 67, folding guide 72, and bottom knot section edge 82. Upper knot section face 65 has a more elongated shape than lower knot section face 75, and narrows towards pull ring 67. Upper knot section face 65 comprises knot section slit 62. Knot section 60 further comprises upper lateral edge 64 connected to lower lateral edge 74 by corner 68, and upper lateral edge 66 connected to lower lateral edge 76 by corner 70. Lower lateral edge 74 is connected to bottom knot section edge 82 by end apex 78, and bottom knot section edge 82 is connected to lower lateral edge 76 by end apex 80. First folding guide 72 is longer than first bottom knot section edge 82.

Figure 7:
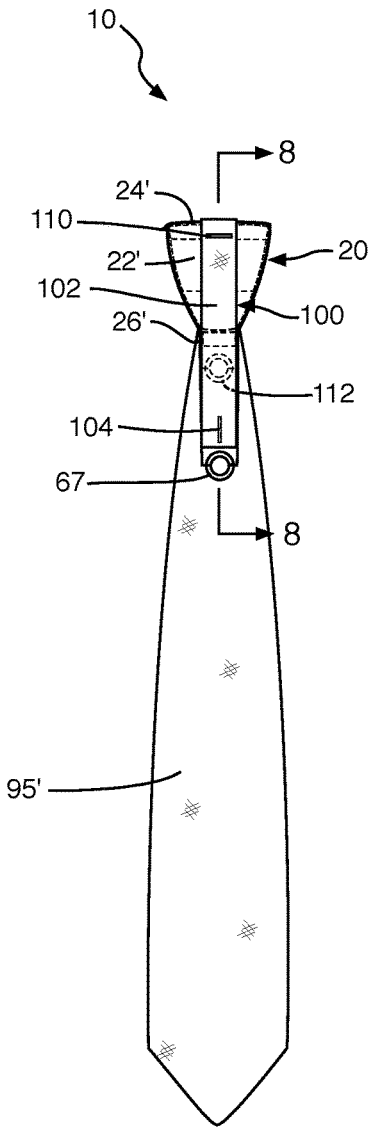
FIG. 7 is a rear view of the present invention in a second assembly step.
Figure 8:
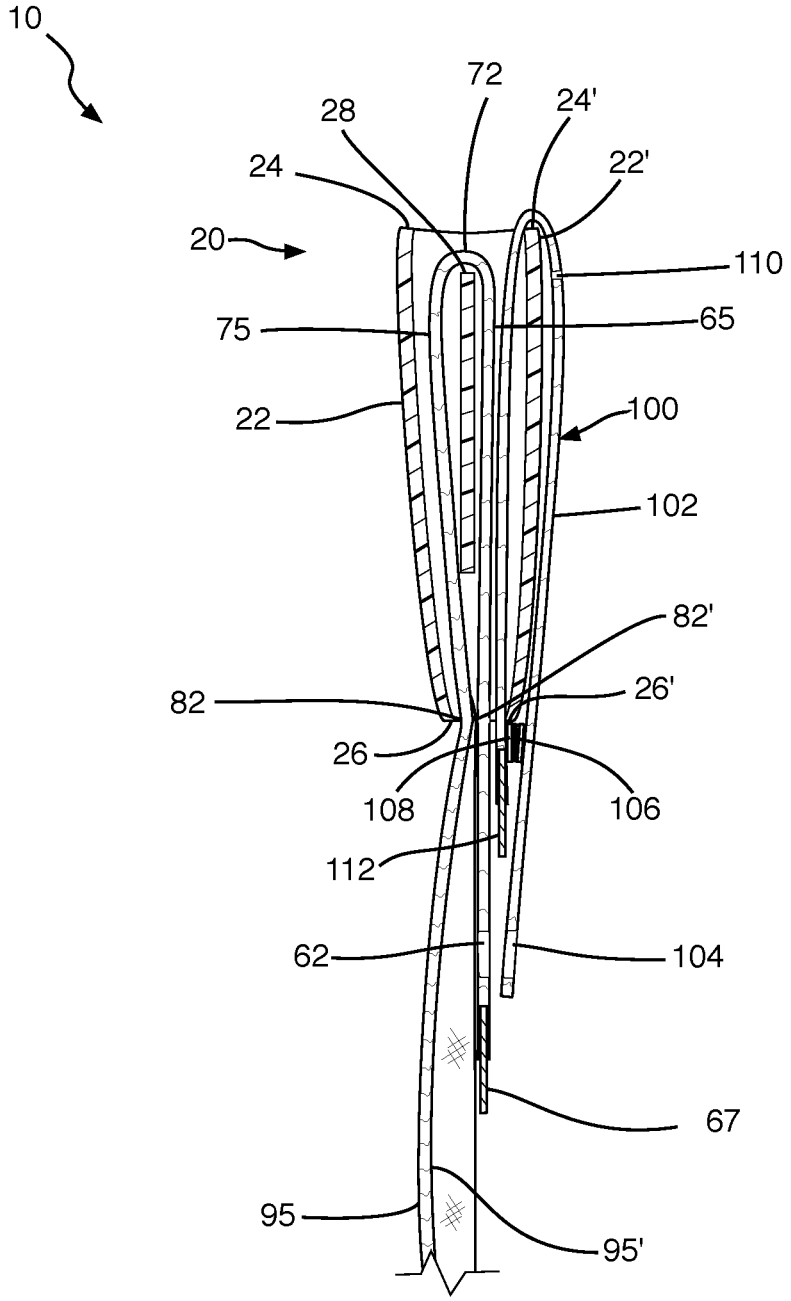
FIG. 8 is a cut view taken along the lines 8-8 as seen in FIG. 7.

Strip assembly 100, comprises strip 102 with first slit 104 and second slit 110 to fix reversible necktie 10 to a shirt, not seen. In an alternate embodiment, second slit 110 may be hook or ring to receive a shirt button. When present invention 10 is worn, strip assembly 100 is positioned through knot assembly 20 as seen in FIGS. 7 and 8. Pull ring 112, positioned at an end opposite first slit 104, is utilized to introduce strip assembly 100 into knot assembly 20 more easily. Hook fastener 106 and loop fastener 108 secure strip assembly 100 around knot assembly 20.

Apron section 90 comprises rolled edges 92 and 94, apron 95, and apron end 96.

Apron 95 also comprises a predetermined appearance that may comprise at least one color, pattern, print, and/or design.

In the illustrated embodiment, the predetermined appearances may be the same or different resulting in a first of four possible combinations of present invention 10.

Figure 2:
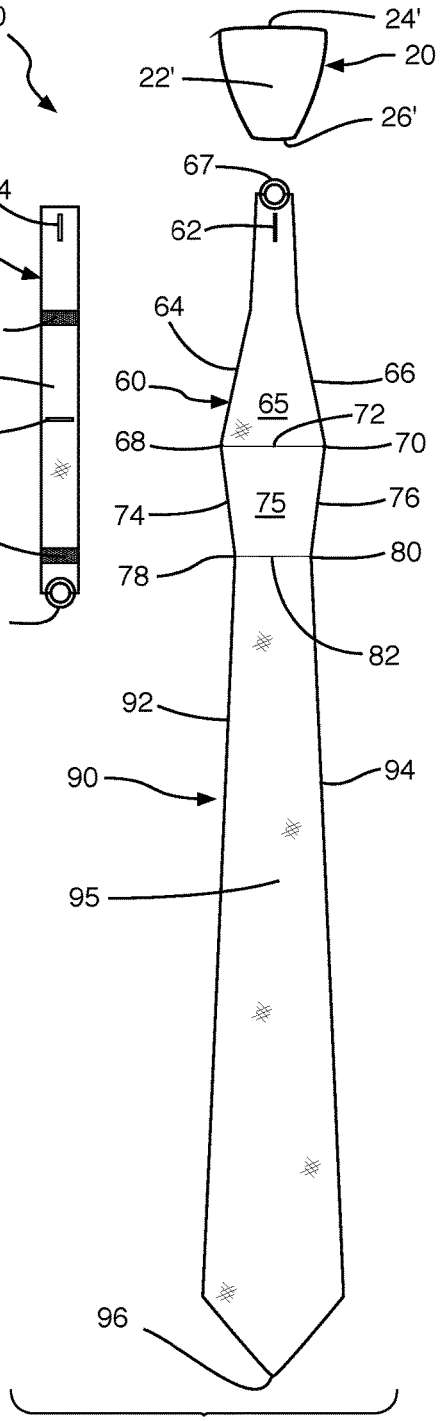
FIG. 2 is a front view of the present invention in a second of four possible combinations.

As seen in FIG. 2, knot assembly 20 also comprises face 22', top edge 24', and bottom edge 26'. Apron section 90 comprises apron 95. Face 22' also comprises a predetermined appearance that may comprise at least one color, pattern, print, and/or design.

In the illustrated embodiment, the predetermined appearances may be the same or different resulting in a second of four possible combinations of present invention 10.

Figure 3:
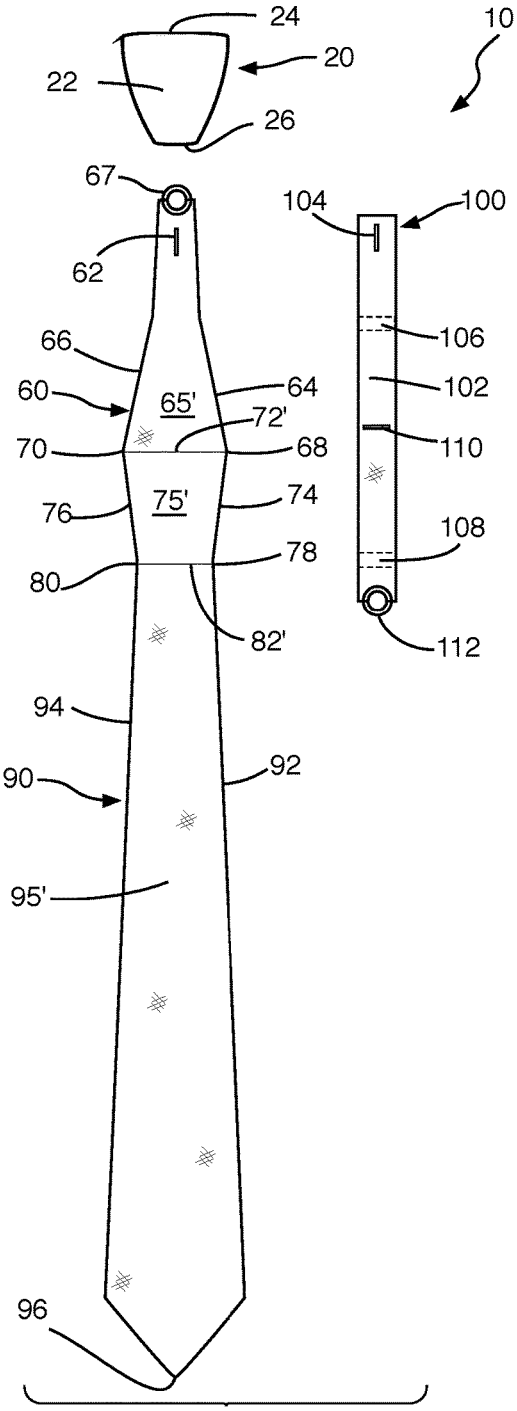
FIG. 3 is a front view of the present invention in a third of four possible combinations.

As seen in FIG. 3 and as detailed above, knot assembly 20 comprises face 22, top edge 24, and bottom edge 26. Face 22 comprises a predetermined appearance that may comprise at least one color, pattern, print, and/or design.

Knot section 60 comprises upper knot section face 65' and lower knot section face 75', which are defined by pull ring 67, folding guide 72', and bottom knot section edge 82'. Upper knot section face 65' has a more elongated shape than lower knot section face 75' and narrows towards pull ring 67. Upper knot section face 65' comprises knot section slit 62. Knot section 60 further comprises upper lateral edge 64 connected to lower lateral edge 74 by corner 68, and upper lateral edge 66 connected to lower lateral edge 76 by corner 70. Lower lateral edge 74 is connected to bottom knot section edge 82' by end apex 78, and bottom knot section edge 82' is connected to lower lateral edge 76 by end apex 80. First folding guide 72' is longer than first bottom knot section edge 82'.

Apron section 90 comprises rolled edges 92 and 94, apron 95', and apron end 96.

Apron 95' also comprises a predetermined appearance that may comprise at least one color, pattern, print, and/or design.

In the illustrated embodiment, the predetermined appearances may be the same or different resulting in a third of four possible combinations of present invention 10.

Figure 4:
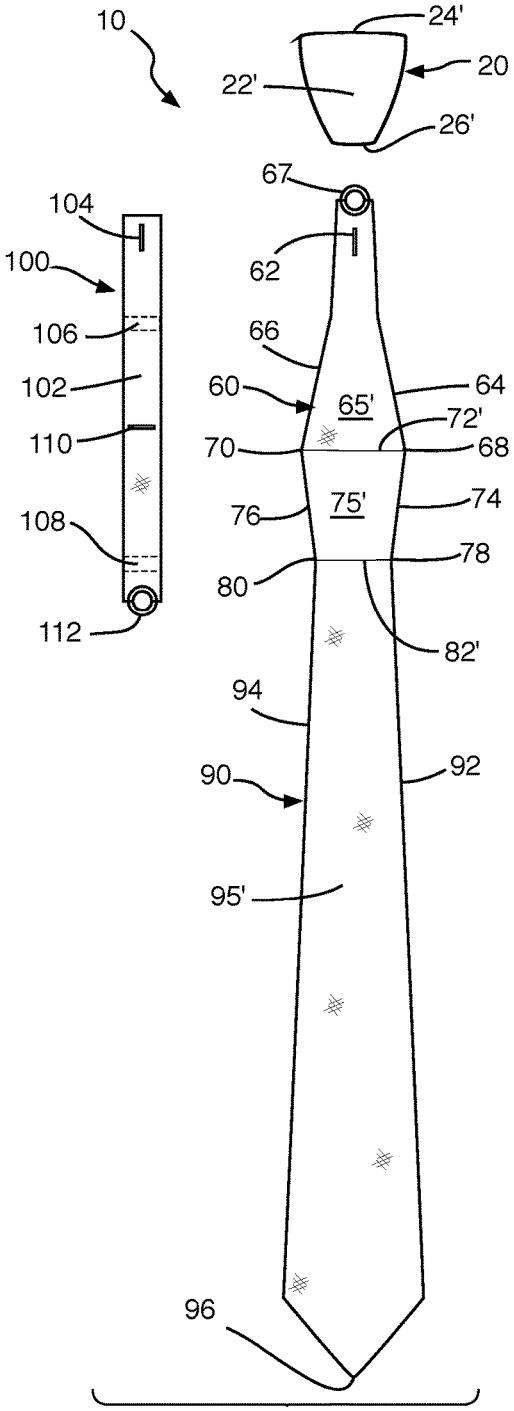
FIG. 4 is a front view of the present invention in a fourth of four possible combinations.

As seen in FIG. 4, in another embodiment of the present invention 10, knot assembly 20 comprises face 22', top edge 24', and bottom edge 26', and apron section 90 comprises apron 95', resulting in a fourth of four possible combinations of present invention 10.

Figure 5:
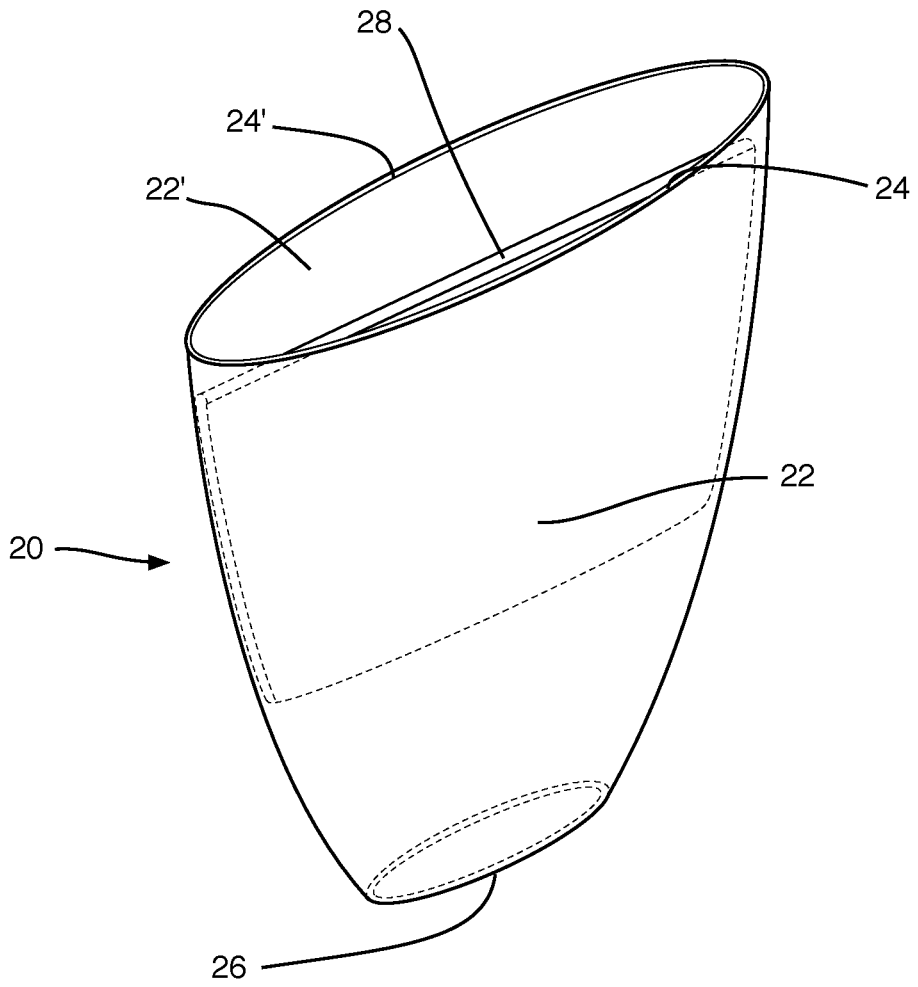
FIG. 5 is an isometric view of a knot assembly of the present invention.

As best seen in FIG. 5, knot assembly 20 further comprises dividing wall 28 positioned internally between faces 22 and 22'. It is noted that a height of dividing wall 28 is shorter than the distances between top edge 24 and bottom edge 26, and top edge 24' and bottom edge 26' respectively. Furthermore, dividing wall 28, positioned internally, does not reach top edge 24 nor bottom edge 26, nor does it reach top edge 24' nor bottom edge 26' respectively.

Figure 6:
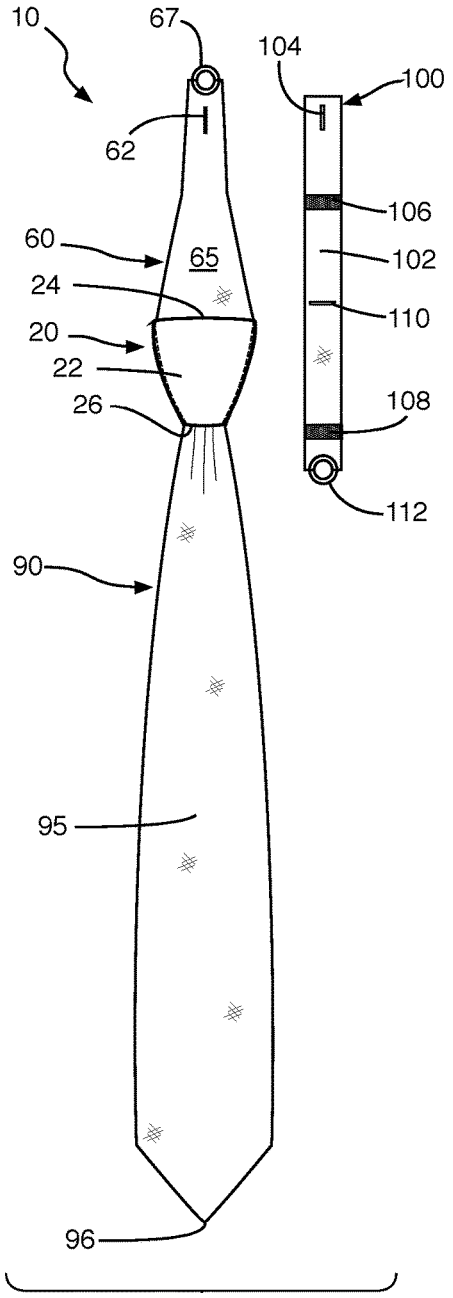
FIG. 6 is a front view of the present invention in a first assembly step.

As seen in FIG. 6 in a first assembly step for one of the four possible combinations of present invention 10, knot section 60 is positioned through knot assembly 20, whereby lower knot section face 75, seen in FIG. 1, is positioned between face 22 and dividing wall 28, seen in FIG. 5, until bottom edge 26 aligns approximately with bottom knot section edge 82, seen in FIG. 1.

As seen in FIGS. 7 and 8, in a second assembly step, upper knot section face 65 folds over dividing wall 28 until folding guide 72 is positioned approximately over a top edge of dividing wall 28. Upper knot section face 65 is then positioned between face 22' and dividing wall 28. After the second assembly step, bottom edges 26 and 26' align approximately with bottom knot section edges 82 and 82' respectively.

In a third assembly step, strip assembly 100 is positioned through knot assembly 20, whereby pull ring 112 is positioned in between face 22' and dividing wall 28 and pulled therefrom to extend from bottom edge 26'. A remaining section of strip 102 folds over face 22' until first slit 104 aligns with knot section slit 62, and hook fastener 106 fastens onto loop fastener 108 to secure strip assembly 100 around knot assembly 20. Second slit 110 is in position to fastened onto a collar button of a shirt, not seen. First slit 104, aligned with knot section slit 62, are fastened together onto a button below the collar button of a shirt, not seen.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A reversible necktie, comprising:

A) a knot assembly, said knot assembly comprises first and second faces, a dividing wall, first and second top edges, and first and second bottom edges;

B) a knot section, said knot section comprises first and second folding guides, and first and second bottom knot section edges;

C) an apron section; and

D) a strip assembly.

2. The reversible necktie set forth in claim 1, further characterized in that said first face comprises a first appearance that is different from a second appearance of said second face.

3. The reversible necktie set forth in claim 2, further characterized in that said first and second appearances comprise at least one color, pattern, print, and/or design.

4. The reversible necktie set forth in claim 1, further characterized in that said first and second folding guides are each longer than said first and second bottom knot section edges respectively.

5. The reversible necktie set forth in claim 1, further characterized in that said knot section comprises first and second upper knot section faces, and first and second lower knot section faces.

6. The reversible necktie set forth in claim 5, further characterized in that said first and second upper knot section faces comprise a knot section slit.

7. The reversible necktie set forth in claim 6, further characterized in that said strip assembly comprises a strip.

8. The reversible necktie set forth in claim 7, further characterized in that said strip comprises first and second slits.

9. The reversible necktie set forth in claim 1, further characterized in that said strip assembly comprises a hook fastener and a loop fastener.

10. The reversible necktie set forth in claim 1, further characterized in that said apron section comprises first and second aprons.

11. The reversible necktie set forth in claim 10, further characterized in that said first apron comprises a first appearance that is different from a second appearance of said second apron.

12. The reversible necktie set forth in claim 11, further characterized in that said first and second appearances comprise at least one color, pattern, print, and/or design.

13. The reversible necktie set forth in claim 1, further characterized in that said knot section is positioned through said knot assembly, whereby said first and second bottom edges align approximately with either said first or second bottom knot section edge.

14. The reversible necktie set forth in claim 5, further characterized in that either of said first or second folding guides folds over said dividing wall and said first and second upper knot section faces are positioned between said dividing wall and said first or second faces and are extended from said first or second bottom edge.

15. The reversible necktie set forth in claim 8, further characterized in that said strip assembly is positioned through said knot assembly and folds over either said first or second face until said first slit is aligned with said knot section slit.

16. The reversible necktie set forth in claim 10, further characterized in that either said first or second face is positioned outwardly to coordinate with either said first or second aprons to achieve four possible combinations to wear.

* * * * *